US012800275B2

(12) United States Patent
Hoffman et al.

(10) Patent No.: US 12,800,275 B2
(45) Date of Patent: Nov. 17, 2026

(54) PELLET PROJECTILE AND CARTRIDGE

(71) Applicant: The United States of America, as Represented by the Secretary of the Navy, Crane, IN (US)

(72) Inventors: Brian R Hoffman, Bloomington, IN (US); Caleb W. McGee, Bloomington, IN (US); Cody L. Walton, Bloomington, IN (US)

(73) Assignee: The United States of America, as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 18/960,299

(22) Filed: Nov. 26, 2024

(65) Prior Publication Data

US 2025/0172374 A1 May 29, 2025

Related U.S. Application Data

(60) Provisional application No. 63/602,855, filed on Nov. 27, 2023.

(51) Int. Cl.
*F42B 14/06* (2006.01)
*F42B 5/02* (2006.01)

(52) U.S. Cl.
CPC ..... *F42B 5/025* (2013.01); *F42B 14/065* (2013.01)

(58) Field of Classification Search
CPC .. F42B 5/03; F42B 12/56; F42B 12/58; F42B 12/62; F42B 14/065; F42B 14/064
See application file for complete search history.

(56) References Cited

U.S. PATENT DOCUMENTS

| | | | | | |
|---|---|---|---|---|---|
| 219,491 | A * | 9/1879 | Mason | F42B 7/04 | 102/452 |
| 3,598,057 | A * | 8/1971 | Potter | F42B 12/64 | 102/460 |
| 4,000,698 | A * | 1/1977 | Corney | F42B 14/064 | 102/522 |
| 4,212,244 | A * | 7/1980 | Flatau | F42B 5/03 | 102/438 |
| 9,207,050 | B2 * | 12/2015 | Sorensen | F42B 7/10 | |

FOREIGN PATENT DOCUMENTS

| | | | | |
|---|---|---|---|---|
| GB | 1605109 A * | 12/1981 | F42B 12/58 |
| WO | WO-2013140182 A1 * | 9/2013 | F42B 7/10 |

* cited by examiner

*Primary Examiner* — Jonathan C Weber
(74) *Attorney, Agent, or Firm* — Naval Surface Warfare Center, Crane Division; Christopher Feigenbutz

(57) ABSTRACT

Disclosed is an improved firearm cartridge that utilizes a pellet projectile. The device comprises a nose with a first half and a second half held together by one or more fracture points to form a hollow interior, one or more sub-projectiles, a rear assembly, and a retaining ring. The nose incorporates spherical sub-projectiles to allow for projectile weight-match to a bullet used in a conventional ball cartridge of the same caliber, equivalent cartridge overall length, and equivalent or similar bullet seating depth. The inventive pellet projectile provides increased range, higher pellet velocity and energy, and improved dispersion at extended ranges with tighter shot groups/patterns when compared to conventional shotguns, thereby increasing the hit probability against targets. The inventive projectile can be fired through weapon/firearm types other than shotguns, such as machine guns and automatic rifles.

43 Claims, 11 Drawing Sheets

PELLET PROJECTILE AND CARTRIDGE

STATEMENT REGARDING FEDERALLY SPONSORED RESEARCH OR DEVELOPMENT

The present application claims priority to U.S. Provisional Patent Application Ser. No. 63/602,855, filed Nov. 27, 2023, entitled "IMPROVED PELLET PROJECTILE AND CARTRIDGE," the disclosure of which is expressly incorporated by reference herein.

CROSS-REFERENCE TO RELATED APPLICATIONS

The invention described herein was made in the performance of official duties by employees of the Department of the Navy and may be manufactured, used and licensed by or for the United States Government for any governmental purpose without payment of any royalties thereon. This invention (Navy Case 211875US02) is assigned to the United States Government and is available for licensing for commercial purposes. Licensing and technical inquiries may be directed to the Technology Transfer Office, Naval Surface Warfare Center Crane, email: Crane_T2@navy.mil.

FIELD OF THE INVENTION

The field of invention relates generally to firearm cartridges. More particularly, it pertains to an improved firearm cartridge and pellet projectile, which incorporates spherical sub-projectiles.

BACKGROUND

Unmanned Aerial Systems (UAS), and especially smaller Group 1 and 2 UAS, are notoriously difficult to incapacitate or kill using kinetic methods via small arms. As is known, even a direct hit on target does not guarantee incapacitation. One means of overcoming this problem is by increasing the number of projectiles in/around the target, such as by using projectiles that are distributed about the point of aim. A variety of multi-projectile cartridge solutions, intended to be fired through small arms (i.e. long guns other than shotguns), have been attempted historically but with limited or no success. "Duplex" and "triplex" rounds incorporate a series of two or three stacked and pointed projectiles in each cartridge to offer projectile multiplication per round fired. These designs, however, generally suffer from lack of projectile dispersion. In other words, each individual projectile follows identically or very closely with the path of the leading projectile. Designs such as these may inflict greater damage if the target is hit, but the lack of projectile dispersion does not necessarily help with increasing the probability of hit. Additionally, the individual projectiles of duplex and triplex rounds can still travel significant distances and carry concerns over collateral damage, as opposed to spherical pellets that are by design less aerodynamically efficient.

Other multi-projectile developmental cartridge types utilize a larger number of smaller sized pellets, which are disbursed to increase the number of individual projectiles per round fired. The small individual pellet size, however, inherently limits the terminal energy available per pellet to inflict damage on the target. Lack of pellet energy also translates into reduced effective range, as the individual pellets will quickly lose their energy even if launched at a high velocity.

Other developmental cartridges that may offer shotgun-style effects with larger pellets that are composed of conventional pellet materials. These designs, however, are not capable of utilizing a weight-matched payload relative to the bullet used in a conventional ball cartridge, and requires an increased cartridge overall length and/or a deeper projectile seating depth into the cartridge case to achieve functional goals. Greater seating depth translates into performance trade-offs often in the form of a propellant and/or charge weight change and subsequent reduction in pellet launch velocity and, by association, kinetic energy and effective range. Additionally, weapon integration may not be straightforward, and weapon reliability may also prove problematic.

Some of the developmental, shotgun-effect style rounds may also require use of a smoothbore barrel to prevent unwanted rotation of the pellets during firing, which can lead to excessive and often donut-shaped dispersion patters of the projectiles. A barrel change is not preferable tactically or from a cost perspective if the ammunition is meant to be fired through exiting rifles, automatic rifles, or machine guns, which all use rifled barrels. Other developmental cartridges may utilize a larger number of smaller pellets in combination with a fuse or timing element to disburse the pellet payload at a prescribed standoff distance from the muzzle in order to offer increased effective range. Actual effectiveness of the approach is still being determined, but independent of performance it comes with added complexity and significant cost increase per round of ammunition.

As can be seen, a new and improved firearm cartridge that increases the hit probability of Unmanned Aerial Systems is desired.

SUMMARY OF THE INVENTION

The present invention relates to an improved firearm cartridge that utilizes a pellet projectile. The device comprises a nose with a first half and a second half held together by one or more fracture points to form a hollow interior, one or more sub-projectiles, a rear assembly, and a retaining ring. The nose incorporates spherical sub-projectiles to allow for projectile weight-match to a bullet used in a conventional ball cartridge of the same caliber, equivalent cartridge overall length, and equivalent or similar bullet seating depth. The inventive pellet projectile provides increased range, higher pellet velocity and energy, and improved dispersion at extended ranges with tighter shot groups/patterns when compared to conventional shotguns, thereby increasing the hit probability against targets. The inventive projectile can be fired through weapon/firearm types other than shotguns, such as machine guns and automatic rifles.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION OF THE DRAWINGS

Figure 1:
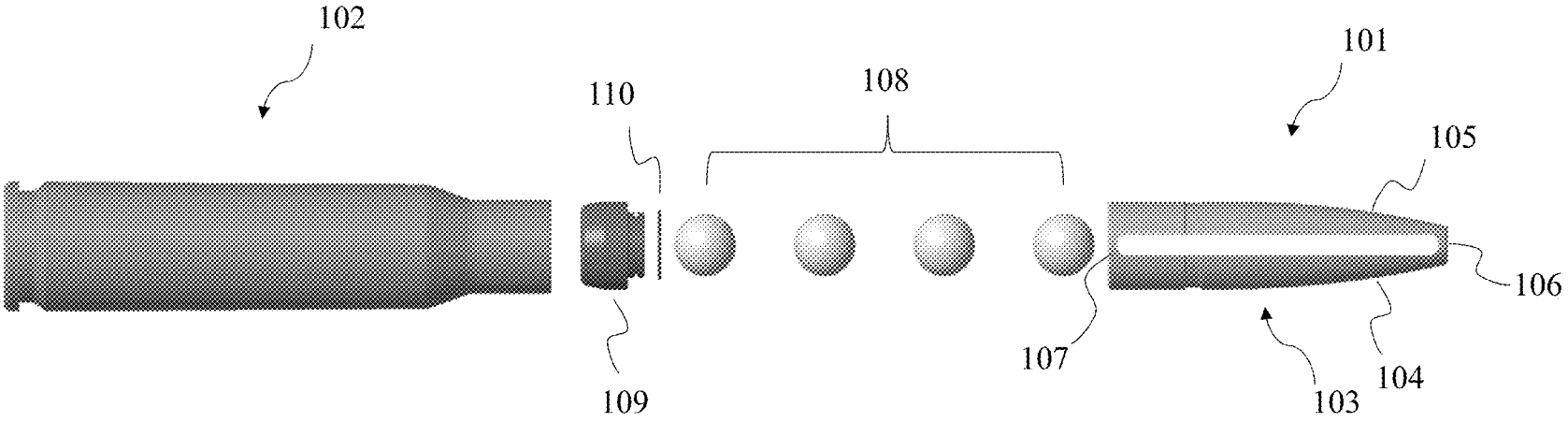
FIG. 1 shows an exploded side view of a pellet projectile and cartridge.

The embodiments of the invention described herein are not intended to be exhaustive or to limit the invention to precise forms disclosed. Rather, the embodiments selected for description have been chosen to enable one skilled in the art to practice the invention.

Generally, provided is a pellet projectile for a firearm comprising: a nose comprising a first half and a second half held together by a fore and an aft fracture point that forms a hollow interior; one or more sub-projectiles positioned within the hollow interior; and a rear assembly.

In an illustrative embodiment, the pellet projectile further comprises a retaining ring securing the nose to the rear assembly. In an illustrative embodiment, the nose further comprises a groove to engage the retaining ring. In an illustrative embodiment, the rear assembly further comprises a groove to engage the retaining ring. In an illustrative embodiment, the nose further comprises a Spitzer shape. In an illustrative embodiment, the nose further comprises a cannelure to accept a case crimp during assembly. In an illustrative embodiment, the nose is constructed of a metal, a metal alloy, a polymer, or a combination of metal, metal alloy, and polymer. In an illustrative embodiment, the one or more sub-projectiles further comprise spherical pellets. In an illustrative embodiment, the one or more sub-projectiles are arranged in an axially inline stack configuration within the nose. In an illustrative embodiment, the one or more sub-projectiles are axially aligned and of a clearance/slip fit within the nose and the rear assembly to minimize contact pressure between the one or more sub-projectiles and the nose and the rear assembly to reduce angular acceleration transmission from firing the pellet projectile through a rifled barrel. In an illustrative embodiment, the one or more sub-projectiles are constructed of lead, steel, copper, tungsten, or a lead, steel, copper, or tungsten alloy. In an illustrative embodiment, the rear assembly further comprises a sub-projectile retainer. In an illustrative embodiment, the sub-projectile retainer further comprises a hemispherical depression equal to or slightly oversized relative to an outer diameter of the sub-projectile. In an illustrative embodiment, the rear assembly is constructed from copper, copper alloy, or brass.

In an illustrative embodiment, disclosed is a pellet projectile for a firearm comprising: a nose comprising a first half and a second half held together by a fore and an aft fracture point that forms a hollow interior; one or more sub-projectiles positioned within the hollow interior; one or more spacers; and a rear assembly.

In an illustrative embodiment, the pellet projectile further comprises a retaining ring securing the nose to the rear assembly. In an illustrative embodiment, the nose further comprises a groove to engage the retaining ring. In an illustrative embodiment, the rear assembly further comprises a groove to engage the retaining ring. In an illustrative embodiment, the nose further comprises a Spitzer shape. In an illustrative embodiment, the nose further comprises a cannelure to accept a case crimp during assembly. In an illustrative embodiment, the nose is constructed of a metal, a metal alloy, a polymer, or a combination of metal, metal alloy, and polymer. In an illustrative embodiment, the one or more sub-projectiles further comprises spherical pellets. In an illustrative embodiment, the one or more sub-projectiles are arranged in an axially inline stack configuration within the nose. In an illustrative embodiment, the one or more sub-projectiles are axially aligned and of a clearance/slip fit within the nose and the rear assembly to minimize contact pressure between the one or more sub-projectiles and the nose and the rear assembly to reduce angular acceleration transmission from firing the pellet projectile through a rifled barrel. In an illustrative embodiment, the one or more sub-projectiles are constructed of lead, steel, copper, tungsten, or a lead, steel, copper, or tungsten alloy. In an illustrative embodiment, the one or more spacers further comprise one or more hemispherical depressions equal to or slightly oversized relative to an outer diameter of the sub-projectile. In an illustrative embodiment, the one or more spacers further comprise a bore. In an illustrative embodiment, the one or more spacers is constructed of a metal, metal alloy, or a polymer.

In an illustrative embodiment, disclosed is a method of firing a pellet projectile for a firearm comprising: providing a pellet projectile comprising: a nose comprising a first half and a second half held together by a fore and an aft fracture point that forms a hollow interior; one or more sub-projectiles positioned within the hollow interior; and a rear assembly; wherein, when fired, the fore and aft ends of the nose fracture into two halves as the nose engages the rifling and rotates; wherein the two halves exit the barrel and flare off as a function of inertia and drag; wherein the one or more sub-projectiles separate from the rear assembly and begin to disperse while traveling downrange.

In an illustrative embodiment, discloses is a pellet projectile for a firearm comprising: a nose comprising a first half and a second half held together by a fracture point that forms a hollow interior; one or more sub-projectiles positioned within the hollow interior; and a rear assembly.

In an illustrative embodiment, the pellet projectile further comprises a retaining ring securing the nose to the rear assembly. In an illustrative embodiment, the nose further comprises a groove to engage the retaining ring. In an illustrative embodiment, the rear assembly further comprises a groove to engage the retaining ring. In an illustrative embodiment, the nose further comprises a Spitzer shape. In an illustrative embodiment, the nose further comprises a cannelure to accept a case crimp during assembly. In an illustrative embodiment, the nose is constructed of a metal, a metal alloy, a polymer, or a combination of metal, metal alloy, and polymer. In an illustrative embodiment, the one or more sub-projectiles further comprises spherical pellets. In an illustrative embodiment, the one or more sub-projectiles are arranged in an axially inline stack configuration within the nose. In an illustrative embodiment, the one or more sub-projectiles are axially aligned and of a clearance/slip fit within the nose and the rear assembly to minimize contact pressure between the one or more sub-projectiles and the nose and the rear assembly to reduce angular acceleration transmission from firing the pellet projectile through a rifled barrel. In an illustrative embodiment, the one or more sub-projectiles are constructed of lead, steel, copper, tungsten, or a lead, steel, copper, or tungsten alloy. In an illustrative embodiment, the rear assembly further comprises a sub-projectile retainer. In an illustrative embodiment, the sub-projectile retainer further comprises a hemispherical depression equal to or slightly oversized relative to an outer diameter of the sub-projectile. In an illustrative embodiment, the one or more spacers further comprise a bore. In an illustrative embodiment, the rear assembly is constructed from copper, copper alloy, or brass.

FIG. 1 shows an exploded view of a pellet projectile 101 and cartridge 102. In an illustrative embodiment, the pellet projectile 101 comprises a nose 103 comprising a first half 104 and a second half 105 held together by fore 106 and aft 107 fracture points to form a hollow interior, one or more sub-projectiles 108, a rear assembly 109, and a retaining ring 110. In an illustrative embodiment, the pellet projectile 101 is designed for use in a centerfire, rifle-sized bottleneck cartridge (i.e., an automatic rifle or machine gun in military use, or bolt-action hunting rifles and modern sporting rifles, such as an AR-15). Alternatively, the pellet projectile 101 can be configured for use in handgun caliber weapons and smoothbore weapons. The pellet projectile 101 and cartridge 102 may be fired through conventional firearms without any gun part changes.

The inventive pellet projectile 101 utilizes a bullet assembly (nose 103, rear assembly 109, retaining ring 110, and one or more sub-projectiles 108) that can be utilized with conventional cartridge components (i.e., cartridge case, primer, and propellant) when assembling the inventive cartridge 102. In some embodiments, the pellet projectile 101 can be weight-matched to the bullet used in a conventional ball cartridge of the same caliber and assembled with a seating depth equivalent to the bullet used in a conventional ball cartridge of the same caliber. This allows for assembly of the inventive pellet projectile 101 within a cartridge 102 utilizing the same propellant and equivalent charge weight as is used in the conventional ball cartridge of the same caliber, which implies equivalent launch velocity to the bullet used in the conventional ball cartridge of the same caliber. As described above, a weight-matched payload of the inventive pellet projectile, relative to a bullet of a conventional ball cartridge in the same caliber, can also be accomplished without the need to increase cartridge overall length (which can lead to functional issues involving cartridge feeding and chambering, for example) or a deeper seating depth into the cartridge case (which often requires a decrease in the amount of propellant and/or charge weight and thereby a reduction in pellet launch velocity, kinetic energy, and effective range).

Figure 2:
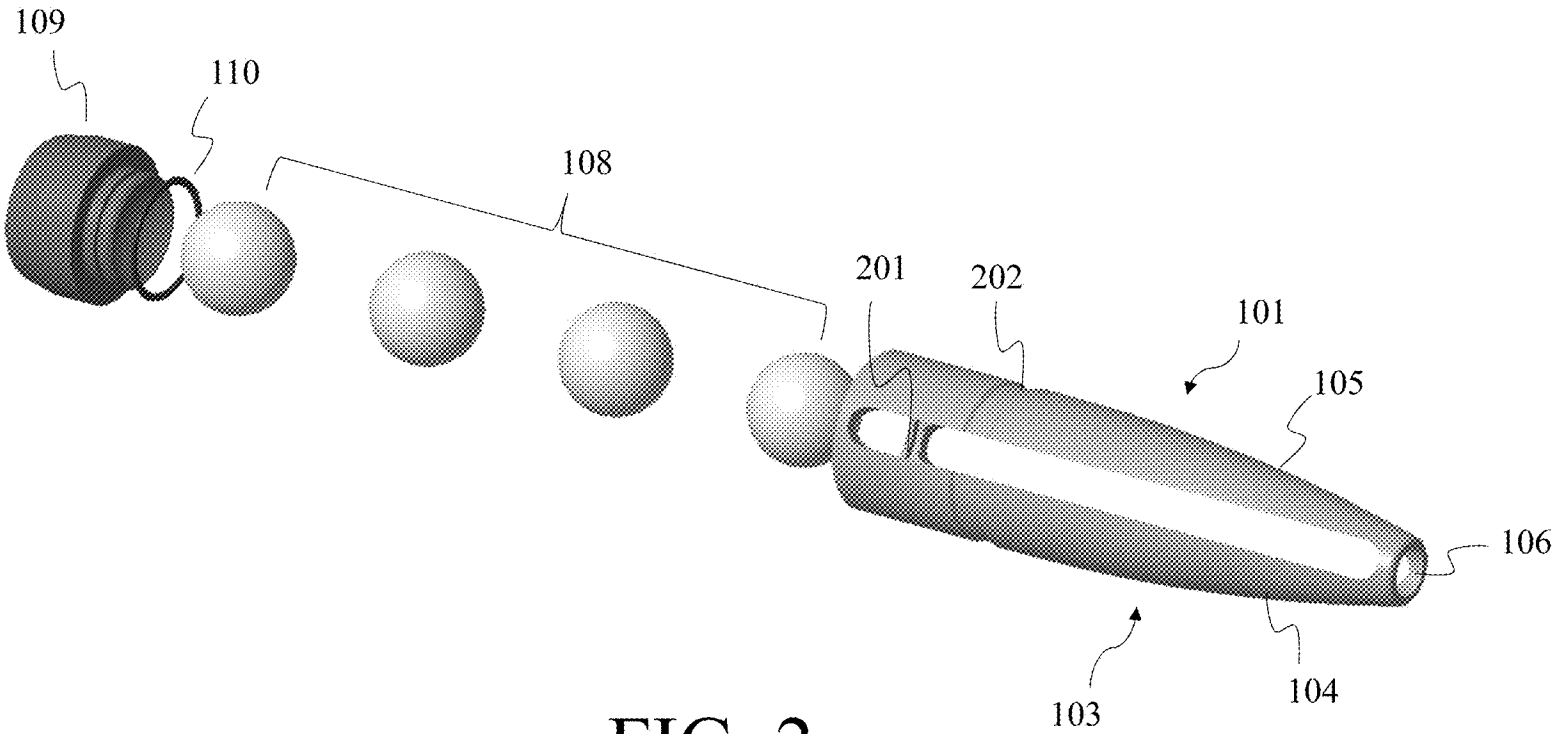
FIG. 2 shows a perspective exploded view of a pellet projectile.

FIG. 2 shows a perspective exploded view of a pellet projectile 101. In an illustrative embodiment, the nose 103 comprises a first half 104 and a second half 105 held together by fore 106 and aft 107 fracture points to form a hollow interior for containing one or more sub-projectiles 108 (which will be shown and discussed in greater detail below). In an illustrative embodiment, the nose 103 can be constructed of a metal alloy (i.e., aluminum) or a polymer. The nose 103 can utilize any conventional bullet shape that is known and used for spin-stabilizing typical bullets that are fired from a rifled bore. In a non-limiting embodiment, the nose 103 utilizes a conventional Spitzer shape. In some embodiments, the nose 103 further comprises a groove 201 to engage the retaining ring 110, which aids in holding the components together during projectile assembly and cartridge loading/assembly. In some embodiments, the nose 103 further comprises a cannelure 202 to accept a conventional case crimp during assembly to aid in bullet retention and help ensure seating depth does not inadvertently change during ammunition transport, rough handling, or movement within the weapon mechanism during use and prior to firing.

Figure 3A:
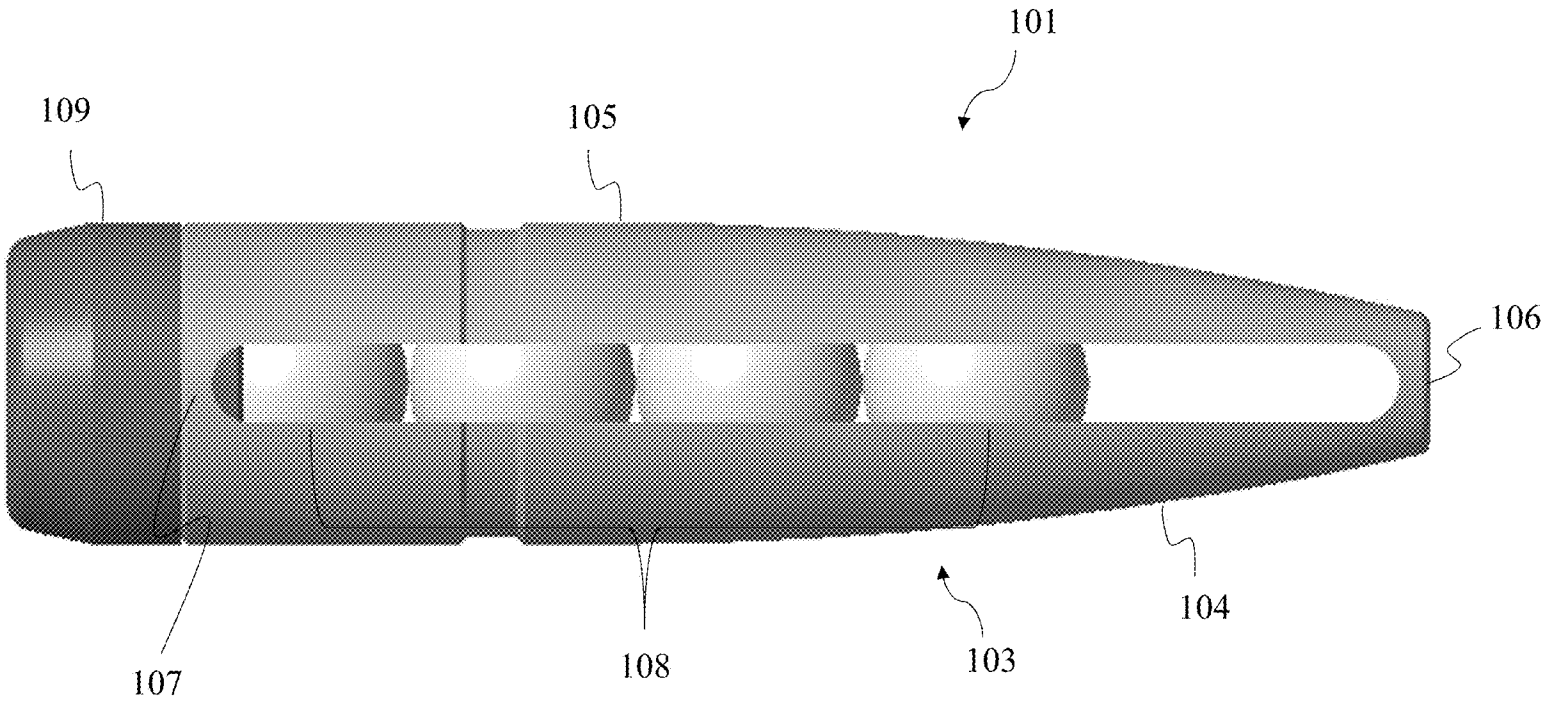
FIG. 3A shows a side view of an assembled pellet projectile.
Figure 3B:
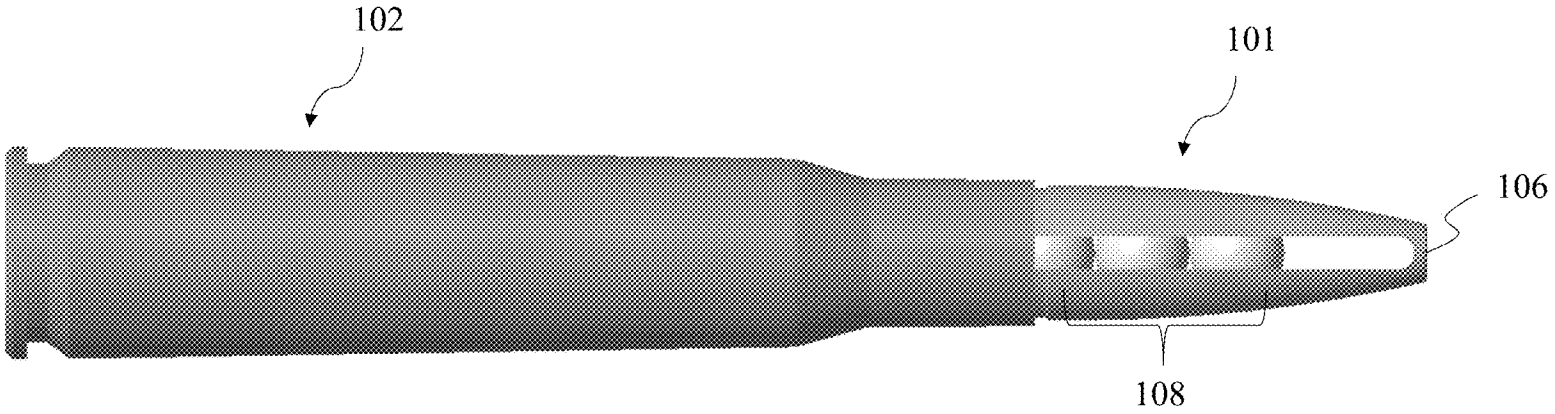
FIG. 3B shows a side view of a pellet projectile and cartridge.

FIG. 3A shows a side view of an assembled pellet projectile 101, and FIG. 3B shows a side view of a pellet projectile 101 and cartridge 102. In an illustrative embodiment, the first half 104 and a second half 105 of the nose 103 are held together by fore 106 and aft 107 fracture points to form a hollow interior. One or more sub-projectiles 108 are positioned within the hollow interior of the nose 103. In an illustrative embodiment, the one or more sub-projectiles 108 are spherical pellets. As can be appreciated, spherical sub-projectiles are far less aerodynamic than spin-stabilized bullets used in standard ammunition. Lower aerodynamic efficiency causes a faster decay in pellet velocity, thereby limiting maximum terminal range. Additionally the terminal velocity (such as when shooting up into the sky, for example, and while the projectiles fall back to Earth under gravity) of the spherical sub-projectiles will be less than the bullets used in conventional rifle rounds. Lower individual mass and lower velocity equates to less energy available to inflict damage in a collateral scenario.

In an illustrative embodiment, the one or more sub-projectiles 108 are constructed of lead, steel, copper, tungsten, or associated alloys of these materials. In a non-limiting embodiment, the one or more sub-projectiles 108 are Tungsten Super Shot (TSS). TSS is an alloy made of approximately 95% Tungsten powder and 5% Nickle/Iron powder to form a projectile with a typical density of 18-18.3 g/cc, which is 60% denser than conventional lead shot. In an illustrative embodiment, the inventive pellet projectile 101 utilizes TSS pellets that are of buckshot size (i.e., pellets having a diameter ranging from 0.24-0.36 inches, or #4 Buc-#000 Buck). As can be appreciated, larger, denser pellets allow for maximum extension of usable range and terminal energy available on target. In an alternative embodiment, conventional materials can be utilized for the pellets (i.e., lead, steel, Bismuth-Tin, and the like). In some embodiments, smaller pellets (below 0.24 inch diameter) may also be beneficially used in certain applications. In some embodiments, the pellet stack comprises several equally-sized pellets. In some embodiments, the pellet stack comprises combinations of different size pellets.

In an illustrative embodiment, the sub-projectiles 108 are arranged in an axially aligned (inline stack) configuration within the hollow interior of the nose 103. Implementing an axially aligned sub-projectile 108 stack along with a diametric clearance/slip fit interface between the overwrapping rear assembly 109 and nose 103 ensures minimal contract pressure at these line-on-surface interfaces and no preloaded diametric contract pressure on the sub-projectiles 108 prior to firing. This serves to reduce the rotational motion transmitted from the nose 103 and rear assembly 109 to the sub-projectiles 108 as the projectile assembly 101 travels down the barrel. In other words, the sub-projectiles 108 effectively experience a slower twist rate than the actual twist rate of the rifling in the barrel (and the rate experienced by the nose 103 and rear assembly 109 that both directly engage the barrel rifling). This is advantageous for the inventive application, as most spherical projectiles require slower twist rates than those found in modem rifled barrels (such as in machine gun and automatic rifles) to produce best possible performance in terms of accuracy and precision. As can be appreciated, preventing or reducing transmitted rotation to the sub-projectiles 108 during firing produces tighter and more useful sub-projectiles 108 dispersion patterns when firing the projectile 101 through modern weapons with rifled barrels of twist rate intended to stabilize bullets used in conventional ball cartridges of the same caliber. In some embodiments, the pellet projectile 101 can be fired through a smoothbore barrel with useful effects.

Figure 4:
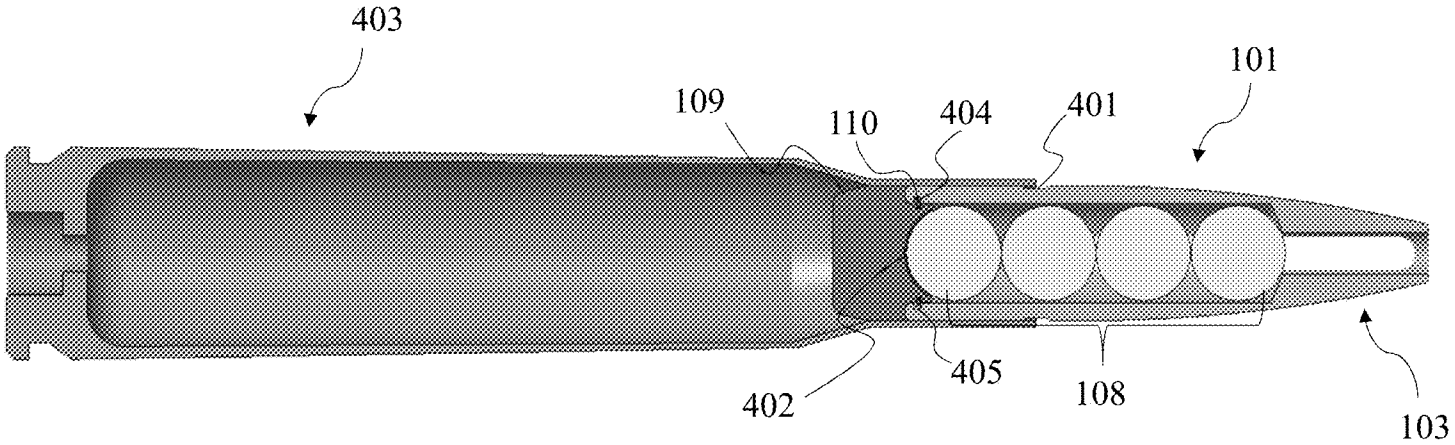
FIG. 4 shows a side axial cross-sectional view of a pellet projectile and cartridge.

FIG. 4 shows a side axial cross-sectional view of a pellet projectile 101 and cartridge 102. The rear assembly 109 makes up the aft end of the projectile, and interfaces with the cartridge case 403, sub-projectiles 108, nose 103, and retaining ring 110. In an illustrative embodiment, the rear assembly 109 is typically constructed from a copper alloy or a brass alloy. The rear assembly 109 directly engages barrel rifling when fired, which will be discussed in greater detail below. The rear assembly 109 secures the components of the pellet projectile 101 together, and is fully contained within the cartridge case 403 prior to firing. The rear assembly 109 and nose 103 are constructed with sufficient diametric clearance to allow the nose 103 to be positioned over and compress the retaining ring 110 during assembly. Groove 404 in nose 103 and groove 405 of rear assembly 109 work in combination to secure the retaining ring 110 in position when assembled and secure rear assembly 109 to the nose 103 as an assembly. In an illustrative embodiment, the rear assembly 109 further comprises a hemispherical depression 402 equal to or slightly oversized relative to an outer diameter of the sub-projectile 108 to enable retention of the sub-projectiles 108 in an in-line stack configuration. The hemispherical depression feature serves to provide adequate bearing area of the sub-projectile 108 in contact with the rear assembly 109 (to accommodating axial force developed during firing without unwanted material deformation) and help reduce required length of the rear assembly 109 and, by association, length of the pellet projectile 101.

Furthermore, the rear assembly 109 functions as an effective additional sub-projectile traveling downrange along with the sub-projectile 108 stack of spherical pellets. The rear assembly 109 directly engages the rifling during firing and remains stable or semi-stable in flight. Its mass, by design, is equivalent or similar to the mass of an individual sub-projectile 108 in the stack, so as to maintain a somewhat similar trajectory match to the other spherical sub-projectiles 108 during flight. In some embodiments, the retaining ring 110 is used to join the nose 103 and rear assembly 109. In some embodiments, the nose 103 and rear assembly 109 components can be held together via adhesive, press fit, staking, crimping, etc.

Figure 5:
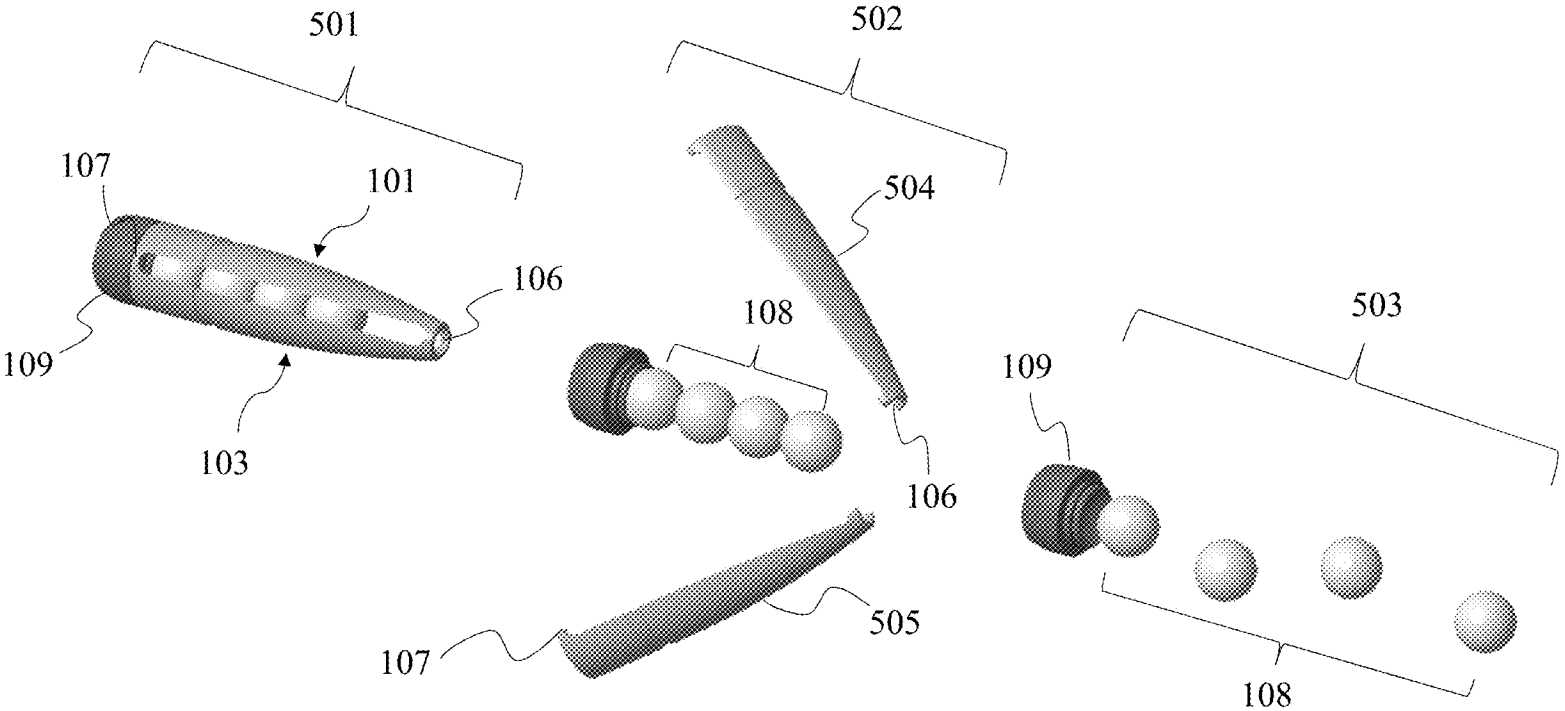
FIG. 5 shows a perspective decomposition sequence of a pellet projectile when fired.

FIG. 5 shows a perspective decomposition sequence of a pellet projectile 101 when fired. The sequence begins at sequence step 501 when the cartridge 102 with pellet projectile 101 is chambered and fired from a firearm in a conventional manner. The nose 103 and rear assembly 109 engages the rifling within the barrel, which imparts spin/rotation as the pellet projectile 101 travels down the bore of the barrel. As discussed above the sub-projectiles 108 have sufficient diametric clearance between the outer diameter of the sub-projectiles 108 and inner diameter of the nose 103 and rear assembly 109 to minimize contact pressure and rotation of the sub-projectiles 108. There is also axial clearance afforded between the length of the stack of sub-projectiles 108 and length between fore and aft limiting interior surfaces (defining length of internal cavity) between assembled nose 103 and rear assembly 109. This combined diametric and axial clearance design precludes any pre-loaded contact pressure between these components prior to firing. Effectively, then, only line-on-surface contact exists at the interfaces once the projectile 101 is fired and starts traveling down the barrel.

Rotation of the nose 103 as it engages the rifling in the barrel, and associated stresses that are developed, cause the fore and aft ends 106, 107 of the nose 103 to fracture when the combined stress state exceeds the structural ability of the nose 103, based on the selected material of the nose 103 and localized structural limitations defined by material properties, design geometry, and heat input (due to friction, which can reduce further reduce material strength). After fracture, the nose 103 and stack of sub-projectiles 108 are still physically constrained by the bore as the components travel down the barrel with the nose halves 504, 505 still rotating due to rifling engagement with the sub-projectiles 108 not rotating or rotating at a slower rate than the nose 103 due to the designed interface between sub-projectiles 108, nose 103, and rear assembly 109 as previously described. Maintaining the stack of sub-projectiles 108 within the nose 103 is important for two reasons. First, it continues to maintain position control and axial alignment of the stack of sub-projectiles 108 prior to launch, which is necessary to yield best dispersion performance when firing these projectiles through weapons/firearms other than shotguns. Second, it precludes any direct physical contact between the stack of sub-projectiles 108 and the barrel rifling. For selected sub-projectile 108 material such as TSS, this attribute is important to prevent any premature or accelerated rifling wear that may otherwise result if the pellets were directly contacting the rifling.

With limited contact area for friction to build, the stack of sub-projectiles 108 "slip" relative to the nose 103 and rear assembly 109 that are spinning due to direct rifling engagement. This slippage is advantageously used to reduce the effective rate of twist experienced by the stack of sub-projectiles 108 despite the nose 103 and rear assembly 109 directly engaging the rifling of conventional twist rates suitable for bullets used in typical ball ammunition.

As the pellet projectile 101 exits the barrel and is no longer constrained by the bore, the two halves 504, 505 of the nose 103 flare off due to inertia and drag, as shown in sequence step 502. The two halves 504, 505 are light and discard quickly under the resistance of air drag. The discarding of the two halves 504, 505 exposes the interior stack of sub-projectiles 108 to allow for its separation. At sequence step 503, the spherical sub-projectiles 108 in the stack begin to separate from the rear assembly 109 as well as from each other. In an illustrative embodiment, full separation can generally occur within 10-20 feet from barrel exit, depending on caliber selection and other embodiment specifics.

In an illustrative embodiment, launch velocities of the pellet projectile 101 (depending on application and caliber) can range from 2,600-3,000 feet per second or more. As can be appreciated, a load comprising #4 Buck-#000 Buck traveling in excess of 3,000 feet per second represents a gain in launch velocity of more than 1,500 feet per second when compared to a similar pellet size payload delivered by a shotgun, which is not capable of withstanding the same level of operating pressures during firing. This increase equates to launch velocities that are 2-2.5 times greater than what a conventional shotgun is able to produce with a comparable sized pellet payload. As can be appreciated, twice the pellet velocity equates to a fourfold increase in kinetic energy per pellet.

Figure 6A:
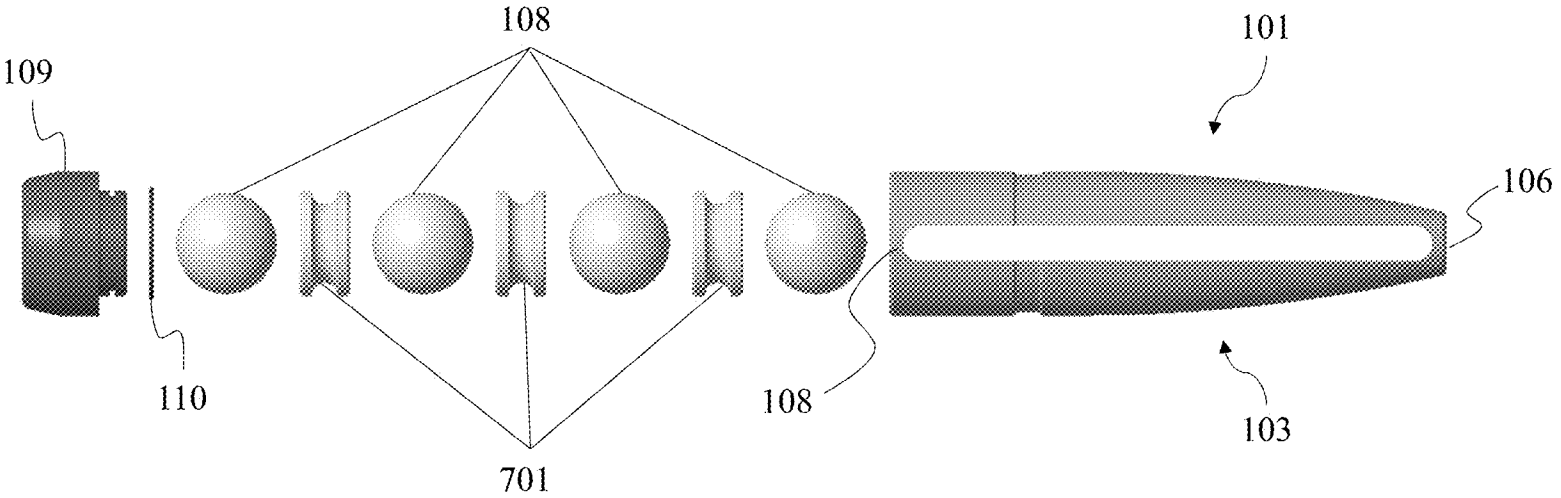
FIG. 6A shows a side exploded view of a pellet projectile embodiment with sub-projectile spacers.
Figure 6B:
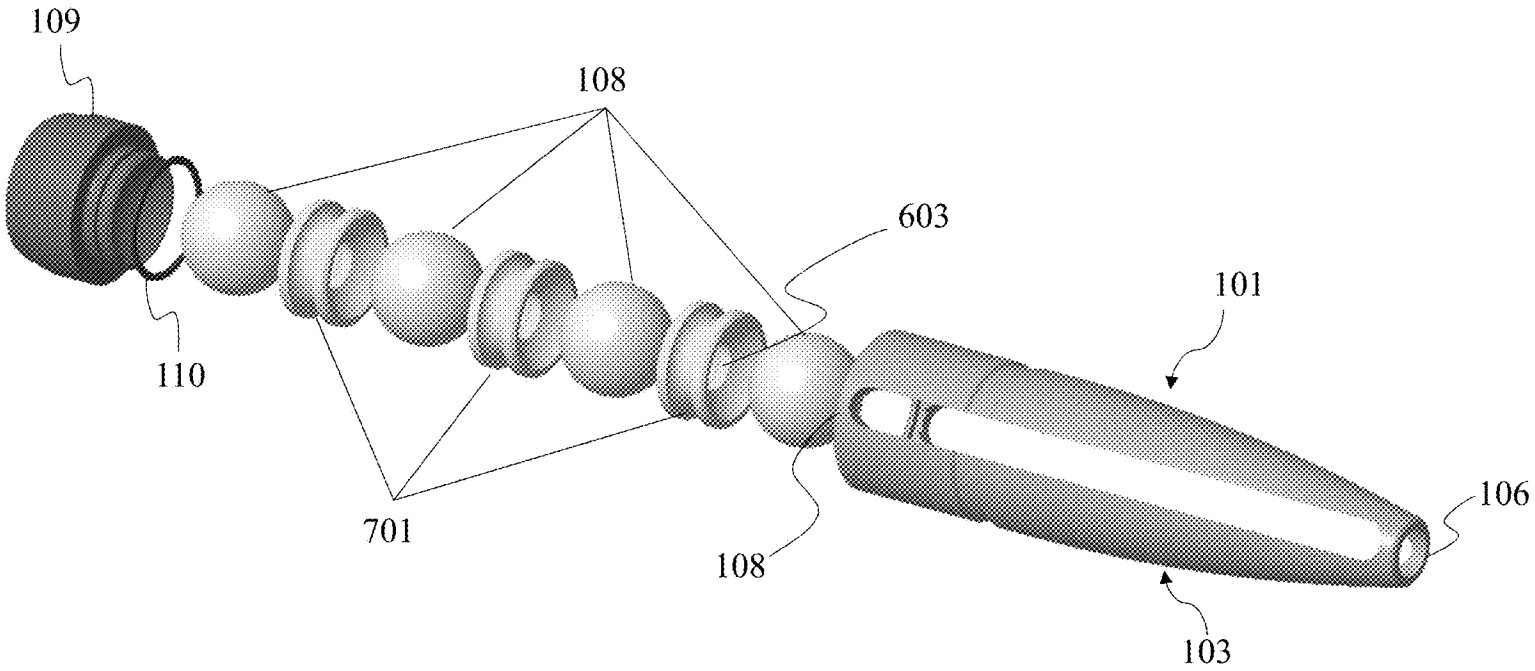
FIG. 6B shows a perspective exploded view of a pellet projectile embodiment with sub-projectile spacers.

FIG. 6A shows a side exploded view of a pellet projectile 101 embodiment with sub-projectile spacers 701, and FIG. 6B shows a perspective exploded view of a pellet projectile 101 embodiment with sub-projectile spacers 701. In an alternate embodiment, the pellet projectile 101 comprises a nose 103 comprising a first half 104 and a second half 105 held together by fore 106 and aft 107 fracture points to form a hollow interior, one or more sub-projectiles 108, one or more sub-projectile spacers 701, a rear assembly 109, and a retaining ring 110. In an illustrative embodiment, a bore 603 is incorporated into each sub-projectile spacer 701 so that the spacer 701 does not alter the length of the sub-projectile 108 stack compared to embodiments that do not utilize sub-projectile spacers 701.

Figure 7:
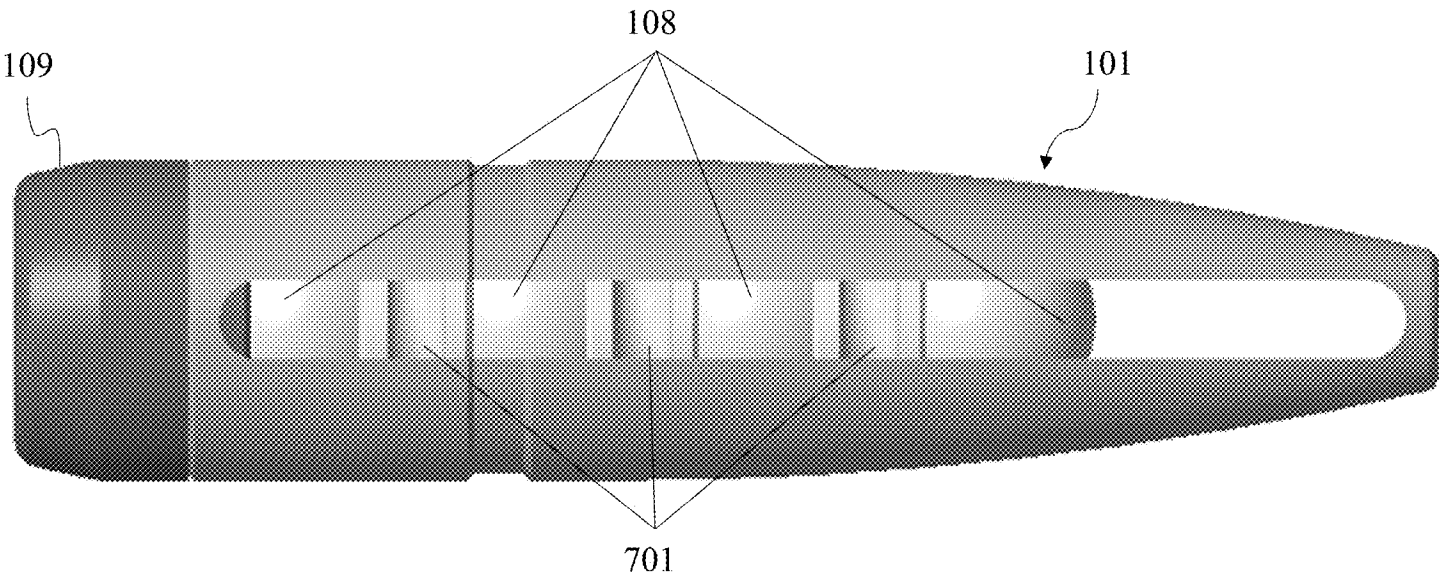
FIG. 7 shows a side view of an assembled pellet projectile with sub-projectile spacers
Figure 8:
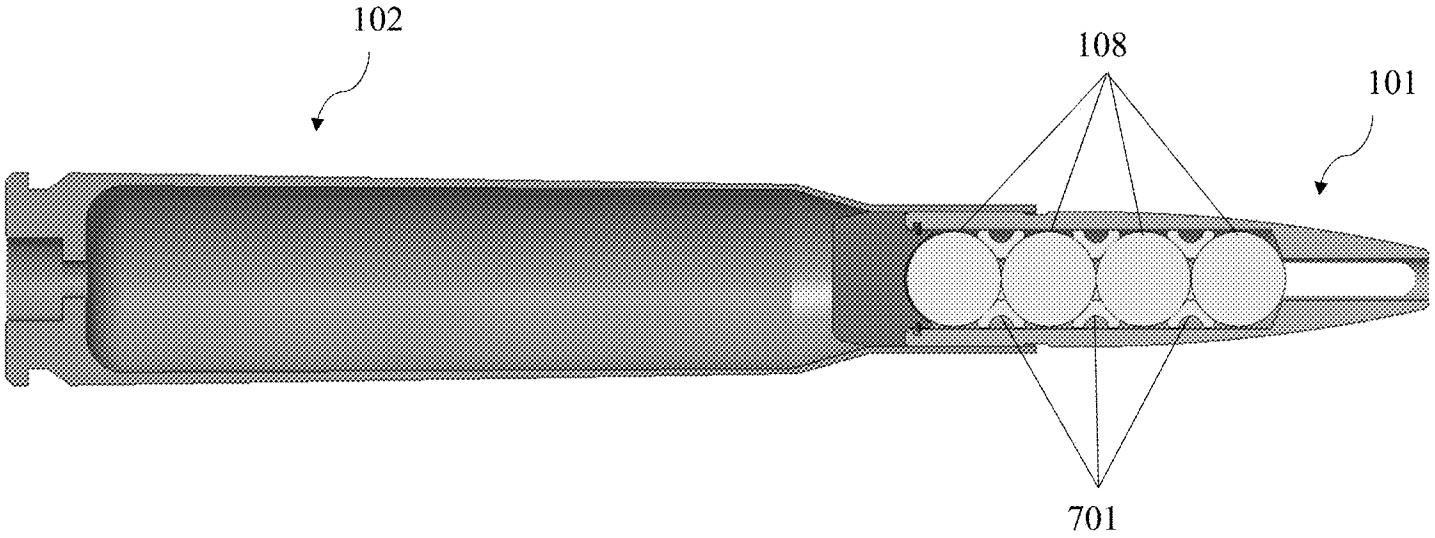
FIG. 8 shows a side axial cross-sectional view of a pellet projectile embodiment with sub-projectile spacers and cartridge.

FIG. 7 shows a side view of an assembled pellet projectile 101 with sub-projectile spacers 701, and FIG. 8 shows a side axial cross-sectional view of a pellet projectile 101 embodiment with sub-projectile spacers 701 and cartridge 102. The one or more sub-projectile spacers 701 further improve the axial alignment of the one or more sub-projectiles 108 stack during the interior ballistic portion of the cycle while the pellet projectile 101 is traveling down the barrel bore. As can be appreciated, better axial alignment translates into improved/tighter sub-projectile 108 dispersion versus range post muzzle exit, thereby providing a greater effective range. Additionally, the sub-projectile spacers 701 serve to prevent or limit the extent of plastic material deformation experienced by the sub-projectiles 108 during firing and as a result of the high axial forces developed during firing. The spacers 701 accomplish this by offering increased bearing/contact area with the sub-projectiles 108 in the axial direction. In an illustrative embodiment, the one or more sub-projectile spacers 701 are constructed from low-density, lightweight materials such as aluminum alloy or a suitable polymer. In an illustrative embodiment, the one or more sub-projectile spacers 701 comprise hemispherical depressions 702 equal to or slightly oversized relative to an outer diameter of the sub-projectile 108.

Figure 9:
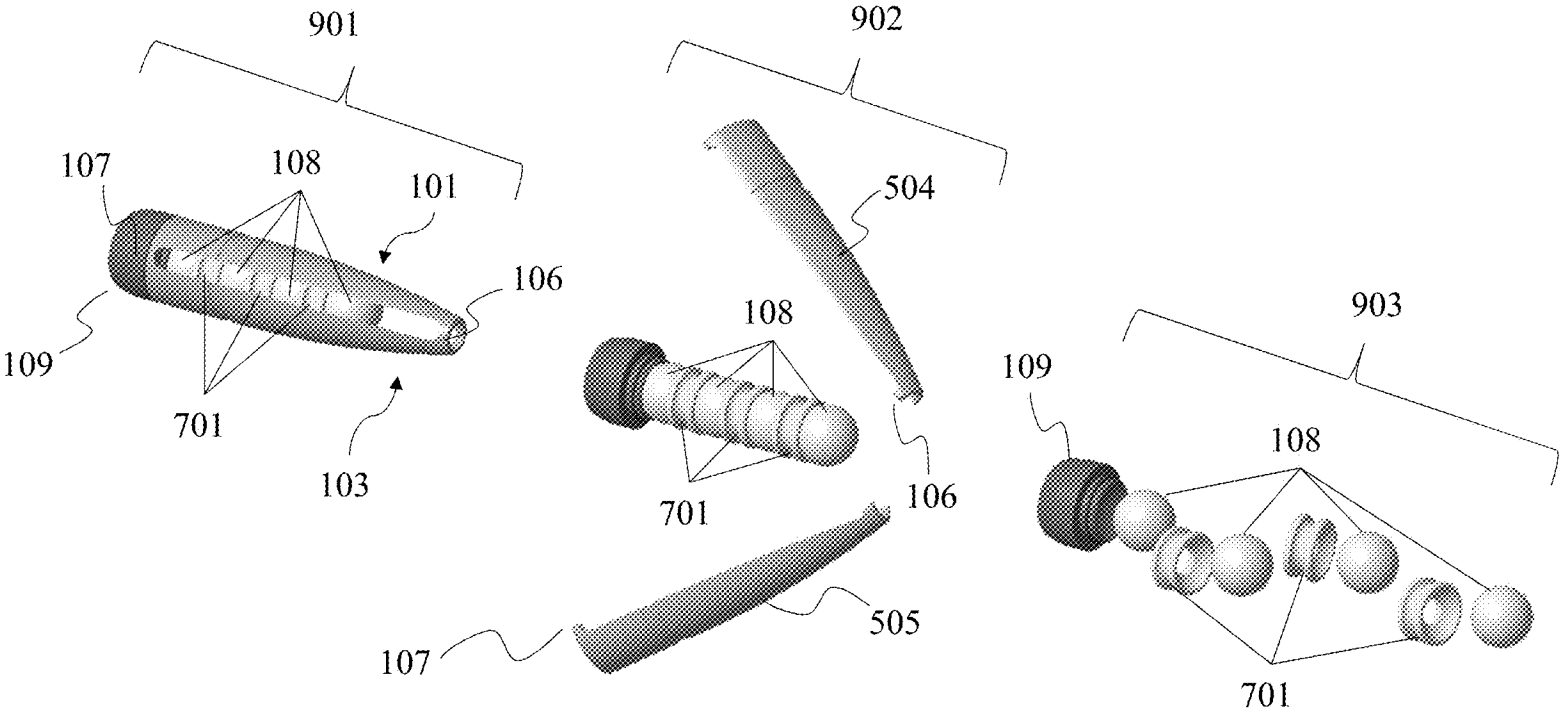
FIG. 9 shows a perspective decomposition sequence of a pellet projectile embodiment with one or more sub-projectile spacers when fired.

FIG. 9 shows a perspective decomposition sequence of a pellet projectile 101 embodiment with one or more sub-projectile spacers 701 when fired. The sequence occurs as described above, with the addition of one or more sub-projectile spacers 701 used to further improve the axial alignment of the stack of sub-projectiles 108 during the interior ballistic portion of the cycle (sequence 901) while the pellet projectile 101 is traveling down the barrel bore. The sub-projectile spacers 701 maintain the sub-projectiles 108 in a stack configuration (sequence 902) as the two halves 504, 505 of the nose 103 flare off due to inertia and drag. The stack of sub-projectiles 108 begins to separate from the rear assembly 109, and the sub-projectile spacers 701 flare off as a function of the very low mass and high drag when compared to the sub-projectiles 108 (sequence 903).

Although the invention has been described in detail with reference to certain preferred embodiments, variations and modifications exist within the spirit and scope of the invention as described and defined in the following claims.

The invention claimed is:

1. A pellet projectile for a firearm comprising:

a nose comprising a first half and a second half held together by a fore fracture point and an aft fracture point that forms a hollow interior;

one or more sub-projectiles positioned within said hollow interior; and a rear assembly;

wherein said fore fracture point and said aft fracture point are configured to fracture said nose into two halves prior to barrel exit.

2. The pellet projectile of claim 1, further comprising a retaining ring securing said nose to said rear assembly.

3. The pellet projectile of claim 2, wherein said nose further comprises a groove to engage said retaining ring.

4. The pellet projectile of claim 2, wherein said rear assembly further comprises a groove to engage said retaining ring.

5. The pellet projectile of claim 1, wherein said nose further comprises a Spitzer shape.

6. The pellet projectile of claim 1, wherein said nose further comprises a cannelure to accept a case crimp during assembly.

7. The pellet projectile of claim 1, wherein said nose is constructed of a metal, a metal alloy, a polymer, or a combination of metal, metal alloy, and polymer.

8. The pellet projectile of claim 1, wherein said one or more sub-projectiles further comprises spherical pellets.

9. The pellet projectile of claim 1, wherein said one or more sub-projectiles are arranged in an axially inline stack configuration within said nose.

10. The pellet projectile of claim 1, wherein said one or more sub-projectiles are axially aligned and have sufficient diametric and axial clearance with said nose and rear assembly to reduce rotational motion transmitted from said nose and said rear assembly to said sub-projectiles as said projectile travels down a firearm barrel upon firing.

11. The pellet projectile of claim 1, wherein said one or more sub-projectiles are constructed of lead, steel, copper, tungsten, or a lead, steel, copper, or tungsten alloy.

12. The pellet projectile of claim 1, wherein said rear assembly further comprises a sub-projectile retainer.

13. The pellet projectile of claim 12, wherein said sub-projectile retainer further comprises a hemispherical depression equal to or slightly oversized relative to an outer diameter of said sub-projectile.

14. The pellet projectile of claim 1, wherein said rear assembly is constructed from copper, copper alloy, or brass.

15. A pellet projectile for a firearm comprising:

a nose comprising a first half and a second half held together by a fore fracture point and an aft fracture point that forms a hollow interior;

one or more sub-projectiles positioned within said hollow interior;

one or more spacers; and a rear assembly;

wherein said fore fracture point and said aft fracture point are configured to fracture said nose into two halves prior to barrel exit.

16. The pellet projectile of claim 15, further comprising a retaining ring securing said nose to said rear assembly.

17. The pellet projectile of claim 16, wherein said nose further comprises a groove to engage said retaining ring.

18. The pellet projectile of claim 15, wherein said rear assembly further comprises a groove to engage said retaining ring.

19. The pellet projectile of claim 15, wherein said nose further comprises a Spitzer shape.

20. The pellet projectile of claim 15, wherein said nose further comprises a cannelure to accept a case crimp during assembly.

21. The pellet projectile of claim 15, wherein said nose is constructed of a metal, a metal alloy, a polymer, or a combination of metal, metal alloy, and polymer.

22. The pellet projectile of claim 15, wherein said one or more sub-projectiles further comprises spherical pellets.

23. The pellet projectile of claim 15, wherein said one or more sub-projectiles are arranged in an axially inline stack configuration within said nose.

24. The pellet projectile of claim 15, wherein said one or more sub-projectiles are axially aligned and have sufficient diametric and axial clearance with said nose and rear assembly to reduce rotational motion transmitted from said nose and said rear assembly to said sub-projectiles as said projectile travels down a firearm barrel upon firing.

25. The pellet projectile of claim 15, wherein said one or more sub-projectiles are constructed of lead, steel, copper, tungsten, or a lead, steel, copper, or tungsten alloy.

26. The pellet projectile of claim 15, wherein said one or more spacers further comprise one or more hemispherical depressions equal to or slightly oversized relative to an outer diameter of said sub-projectile.

27. The pellet projectile of claim 15, wherein said one or more spacers further comprise a bore.

28. The pellet projectile of claim 15, wherein said one or more spacers is constructed of a metal, metal alloy, or a polymer.

29. A pellet projectile for a firearm comprising:

a nose comprising a first half and a second half held together by an aft fracture point that forms a hollow interior;

one or more sub-projectiles positioned within said hollow interior; and a rear assembly;

wherein said aft fracture point is configured to fracture said nose into two halves prior to barrel exit.

30. The pellet projectile of claim 29, further comprising a retaining ring securing said nose to said rear assembly.

31. The pellet projectile of claim 30, wherein said nose further comprises a groove to engage said retaining ring.

32. The pellet projectile of claim 30, wherein said rear assembly further comprises a groove to engage said retaining ring.

33. The pellet projectile of claim 29, wherein said nose further comprises a Spitzer shape.

34. The pellet projectile of claim 29, wherein said nose further comprises a cannelure to accept a case crimp during assembly.

35. The pellet projectile of claim 29, wherein said nose is constructed of a metal, a metal alloy, a polymer, or a combination of metal, metal alloy, and polymer.

36. The pellet projectile of claim 29, wherein said one or more sub-projectiles further comprises spherical pellets.

37. The pellet projectile of claim 29, wherein said one or more sub-projectiles are arranged in an axially inline stack configuration within said nose.

38. The pellet projectile of claim 29, wherein said one or more sub-projectiles are axially aligned and have sufficient diametric and axial clearance with said nose and rear assembly to reduce rotational motion transmitted from said nose and said rear assembly to said sub-projectiles as said projectile travels down a firearm barrel upon firing.

39. The pellet projectile of claim 29, wherein said one or more sub-projectiles are constructed of lead, steel, copper, tungsten, or a lead, steel, copper, or tungsten alloy.

40. The pellet projectile of claim 29, wherein said rear assembly further comprises a sub-projectile retainer.

41. The pellet projectile of claim 40, wherein said sub-projectile retainer further comprises a hemispherical depression equal to or slightly oversized relative to an outer diameter of said sub-projectile.

42. The pellet projectile of claim 40, further comprising one or more spacers.

43. The pellet projectile of claim 29, wherein said rear assembly is constructed from copper, copper alloy, or brass.

* * * * *